US006651600B1

(12) United States Patent
Schafer et al.

(10) Patent No.: US 6,651,600 B1
(45) Date of Patent: Nov. 25, 2003

(54) ROTARY PISTON ADJUSTER

(75) Inventors: Jens Schafer, Herzogenaurach (DE); Martin Steigerwald, Herzogenaurach (DE)

(73) Assignee: Ina-Schaeffler KG (DE)

( * ) Notice: Subject to any disclaimer, the term of this patent is extended or adjusted under 35 U.S.C. 154(b) by 0 days.

(21) Appl. No.: 10/168,472

(22) PCT Filed: Nov. 28, 2000

(86) PCT No.: PCT/EP00/11866

§ 371 (c)(1),
(2), (4) Date: Jul. 24, 2002

(87) PCT Pub. No.: WO01/44627

PCT Pub. Date: Jun. 21, 2001

(30) Foreign Application Priority Data

Dec. 18, 1999 (DE) ..... 199 61 193

(51) Int. Cl.[7] ..... F01L 1/34

(52) U.S. Cl. ..... 123/90.17; 123/90.15; 123/90.27; 123/90.31; 464/160

(58) Field of Search ..... 123/90.15, 90.16, 123/90.17, 90.18, 90.27, 90.31; 464/1, 2, 160; 251/12

(56) References Cited

U.S. PATENT DOCUMENTS 4,858,572 A * 8/1989 Shirai et al. ..... 123/90.12
5,816,204 A * 10/1998 Moriya et al. ..... 123/90.17
5,832,887 A * 11/1998 Adachi et al. ..... 123/90.17
5,865,150 A * 2/1999 Kramer et al. ..... 123/90.17
5,957,098 A * 9/1999 Fukuhara et al. ..... 123/90.17

FOREIGN PATENT DOCUMENTS

| | | | | |
|---|---|---|---|---|
| DE | 19849959 | | 5/1999 | |
| DE | 19755495 | | 6/1999 | |
| DE | 19808618 | | 9/1999 | |
| DE | 19914767 | | 10/1999 | |
| JP | 01092504 A | * | 4/1989 | ..... F01L/1/34 |
| JP | 11182214 A | * | 7/1999 | ..... F01L/1/34 |
| JP | 11264303 | | 9/1999 | |
| JP | 11343819 | | 12/1999 | |

* cited by examiner

*Primary Examiner*—Thomas Denion
*Assistant Examiner*—Ching Chang
(74) *Attorney, Agent, or Firm*—Muserlian, Lucas and Mercanti

(57) ABSTRACT

The invention concerns a rotary piston adjuster for adjusting the angular position of the camshaft of an internal combustion engine, said adjuster comprising an outer rotor having at least one hydraulic chamber and an inner rotor having at least one pivoting vane that can pivot hydraulically between a retard stop position and an advance stop position, said adjuster further comprising a locking device suitable for detachably connecting the outer and inner rotors.

Operational reliability and wear resistance as well as less constructional work are achieved according to the invention by the fact that the locking device (8) and the stops (27, 28) are arranged in an attachment (4) that is connected to the rotary piston adjuster and whose components are wear-resistant.

10 Claims, 3 Drawing Sheets

ROTARY PISTON ADJUSTER

This application is a 371 of PCT/EP00/11866 filed Nov. 28, 2000.

FIELD OF THE INVENTION

The invention concerns a rotary piston adjuster for adjusting the angular position of the camshaft of an internal combustion engine said adjuster comprising an outer rotor connected to a drive pinion and an inner rotor connected to the camshaft, the outer rotor comprising at least one hydraulic chamber having radial separating walls and the inner rotor comprising at least one pivoting vane that sealingly divides the hydraulic chamber into working chambers A and B and can pivot hydraulically between a retard stop position and an advance stop position, said adjuster further comprising a locking device suitable for detachably connecting the outer and the inner rotors.

BACKGROUND OF THE INVENTION

During the stopping and starting phases of an internal combustion engine, clattering noises are caused by the alternating torque of the camshaft when the rotary piston adjuster has been drained. To prevent these noises, the outer rotor and the inner rotor of the rotary piston adjuster are connected to each other in the start position which, in the case of a rotary piston adjuster of an inlet camshaft is the retard position and in the case of a rotary piston adjuster of an outlet camshaft, the advance position. In this way, besides a suppression of noise, a reliable engine start is also obtained.

There are numerous solutions for a reciprocal locking or latching of the outer and the inner rotor. The generic document DE 197 26 300 A1 discloses a rotary piston adjuster that is configured as a vane-type adjuster for adjusting the angular position of the camshaft of an internal combustion engine, said adjuster comprising an outer rotor connected to a drive pinion and an inner rotor connected to the camshaft. The outer rotor comprises at least one hydraulic chamber with radial separating walls, and the inner rotor comprises at least one pivoting vane that sealingly divides the hydraulic chamber into a working chamber A and a working chamber B while being hydraulically pivotable between a retard and an advance stop position. Further, a locking device for detachably connecting the inner and outer rotors is also provided.

This vane-type adjuster comprises in one of the vanes, an axially arranged, spring-loaded fixing pin whose conical tip is adapted to be introduced into a matching conical aperture in an end cover of the vane-type adjuster in one of the stop positions. Due to the slightly eccentric movement of the conical tip of the fixing pin into the conical opening, the pin has a wedge effect that results in a clearance-free locking of the outer and inner rotors. This latching and locking device operates reliably but is complex and prone to wear.

OBJECT OF THE INVENTION

The object of the invention is therefore to provide a reliably operating, inexpensive and durable locking device for a rotary piston adjuster of the pre-cited type.

SUMMARY OF THE INVENTION

The division of the rotary piston adjuster into the adjuster, as such, and the attachment comprising the locking device and the stops permits the use of an optimum material for the intended purpose in each case. Thus, for example, the not so highly loaded outer and inner rotors can be made of soft materials, like light metals or plastic, and the pointwise highly loaded components of the locking device and the stops can be made of wear-resistant materials such as hardened steel. The easy-to-work soft materials reduce the cost of construction and the wear-resistant materials reduce the space requirement, while the durability and the operational reliability of the rotary piston adjuster are enhanced.

A further advantage of the inventive solution is that the same type of attachment can be used with different types of rotary piston adjusters, and its modification is possible independently of the rotary piston adjuster.

The fact that the attachment at the same time forms the end closure of the outer rotor leads to a saving of axial design space. However, it is also conceivable to configure the drive pinion as an intermediate plate and arrange the locking device and the stops on the drive end while closing the end of the rotary piston adjuster directed away from the camshaft with a simple cover.

Advantageously, the locking device comprises a locking body configured as a flat slide that is guided in a guide groove of the intermediate plate that is connected to the outer rotor. Such a locking body requires only a small axial design space and is simple to make.

According to another advantageous feature of the invention, the disc-shaped bushing that is connected to the inner rotor is sealingly guided in a coaxial bore of the intermediate plate as well as between the side washer and the cover, and the intermediate plate comprises on the periphery of its coaxial bore, a circular segment-shaped recess into which the guide groove opens and whose radially extending end surfaces are configured respectively as a retard and an advance stop. Since the intermediate plate is made of a wear-resistant material, its stops and the guide groove are also wear-resistant.

According to still another advantageous feature of the invention, a peg is arranged on the outer periphery of the disc-shaped bushing and comprises a first and a second radially extending side surface serving as stop surfaces, said peg being pivotable in the circular segment-shaped recess of the intermediate plate between its retard and advance stops. Since the disc-shaped bushing is made of a wear resistant material, the stop surfaces of the peg are also wear-resistant.

The important thing is that, depending on the position of the guide groove in one of the two stop positions of the peg, the locking body can be pushed by a locking spring into the circular segment-shaped recess at an acute angle $\alpha$ to one of the radially extending side surfaces of the peg till a pressure contact acting in peripheral direction is established between a preferably radially extending pressure contact surface of the locking body and one of the radially extending side surfaces of the peg. With an appropriate position of the radial guide groove, it is possible to lock the inner rotor on the advance stop (outlet camshaft) or on the retard stop (inlet camshaft). That radially extending side surface of the peg that is not in abutment with the stop serves in each case as a counter surface of the locking body when it is in the locking position. The locking body is pushed by the locking spring toward the center till the rotational lash becomes equal to zero. The adjustment of the rotational lash required during the assembly of the rotary piston adjuster for reducing noise can thus be dispensed with in the locking device of the invention. The device is even self-locking i.e., an enlargement of the rotational lash due to wear is compensated for by an inward displacement of the locking body by the locking spring.

Due to the fact that the locking body, by reason of the magnitude of the angle α included between its pressure contact surface and its direction of displacement is situated at the borderline of self-locking (quasi self-locking), an unlocking of the locking body under the influence of torque as well as a non-releasable clamping are prevented. This means that the rotary piston adjuster has a high operational reliability.

In an advantageous embodiment of the invention, the spring-distal end of the locking body is in fluid communication with the working chamber A, and its spring-proximate end is preferably in fluid communication with the working chamber B. In the case of an inlet camshaft that is generally locked in the retard position, the rotary piston adjuster bears, at least temporarily, against the retard stop under the influence of the frictional torque of the camshaft when the engine is started. The oil pressure required in the working chamber A for overcoming the frictional torque is then also sufficient for a clamp-free unlocking of the locking body.

Conditions are different in the case of an outlet camshaft whose rotary piston adjuster is generally locked in the advance position. When the internal combustion engine is started, the frictional torque of the camshaft, that acts in the same direction as the oil pressure of the working chamber A, causes the rotary piston adjuster to lift from the advance stop which results in a clamping of the locking body. For this reason, the locking body has first to be relieved of load by a pressurizing of the working chamber B to be subsequently unlocked without clamping by this very oil pressure. To maintain the unlocked state even when the working chamber A is pressurized, the locking body must also be pressurizable with the oil pressure of this working chamber. This can be realized with a stepped locking body whose end face is acted upon by the oil pressure of the working chamber A and whose stepped shoulder is acted upon by the oil pressure of the working chamber B.

The locking spring of the locking body can be configured as a coil compression spring (a single spring or a plurality of springs) or as a mini block spring. It can be made of a circular spring wire or, with the aim of enhancing the design-space-related energy absorption, of a rectangular spring wire. The mini block spring can have a slightly conical configuration. In this way, when the spring is compressed, the turns can get inter-inserted so that a small overall height is obtained.

It is of advantage if the separating walls and the pivoting vanes are spaced from each other in the direction of pivot even in the stop positions. This is made possible by the external stops that render an abutment between the separating walls and the pivoting vanes superfluous. The space formed by the spaced arrangement in the direction of pivot serves for the collection of chips and dirt particles out of the oil circuit. The shape of this space is defined in the present case by the radially extending side surfaces of the separating walls and the parallel side walls of the pivoting vanes.

In an alternative embodiment of the locking device, the locking body is configured as a flat slide that is guided in a radial guide groove in the end face of one of the separating walls of the outer rotor and can be displaced into an opening of the inner rotor in one of the stop positions of the inner rotor. Due to the fact that the radial guide groove of the locking body is disposed in the end face of one of the separating walls and the opening is disposed in the end face of the inner rotor, this locking device does not require any additional design width. This also applies to the stops if these are arranged in the interior of the rotary piston adjuster.

Advantageously, the opening is configured in the end of the inner rotor as a groove extending parallel to the axis of the inner rotor on the periphery thereof. One of the legs of the groove comprises a radially extending bevel that can be brought into a pressure contact in peripheral direction with a corresponding counter bevel of a pressure contact surface of the locking body through an inward displacement of the locking body by the spring force of a locking spring. This arrangement of the locking body offers the same advantages relative to the compensation of lash caused by assembling and wear conditions and relative to the self-locking of the locking body as the embodiment comprising an attachment. In the present embodiment, too, the stops can be arranged in an attachment.

Advantageously, the groove is in fluid communication with the working chamber A' through a radial groove arranged in the end of the inner rotor, and the spring-proximate end of the locking body is in fluid communication preferably with the working chamber B' through a vent groove arranged in the end face of a separating wall. As for a clamp-free unlocking in the advance or retard position, the same applies as in the embodiment comprising an attachment. The magnitude of the unlocking force can be influenced through the width of the locking body. It is also conceivable to configure the locking body as a flat slide whose guide surfaces form a wedge shape with each other. However, a drawback of this is the inadequate lateral guidance outside of the end position.

Other locking devices are also conceivable, for example, in the form of a slightly conical locking pin which emerges axially or radially out of the outer rotor to be positioned in front of a pivoting vane that is in a stop position. A drawback of this is the axial and radial space requirement of the locking pin in the unlocked state. For a clamp-free unlocking in both stop positions, the pin must have a stepped configuration comprising functional surfaces and connecting ducts for the pressure oil of both chambers.

Other camshaft adjusters known from the prior art can be locked in any desired position. A locking of the inner rotor in different positions between the stop positions can be achieved with the inventive solution by using a plurality of locking bodies. Alternatively, the locking body may be configured so as to additionally engage into a recess on the periphery of the peg of the disc-shaped bushing.

Further features of the invention are disclosed in the claims, in the following description and in the drawings in which examples of embodiment of the invention are schematically represented.

BRIEF DESCRIPTION OF THE DRAWINGS

The invention will now be described with reference to some examples of embodiment. The appended drawings show.

DETAILED DESCRIPTION OF THE DRAWINGS

Figure 1:
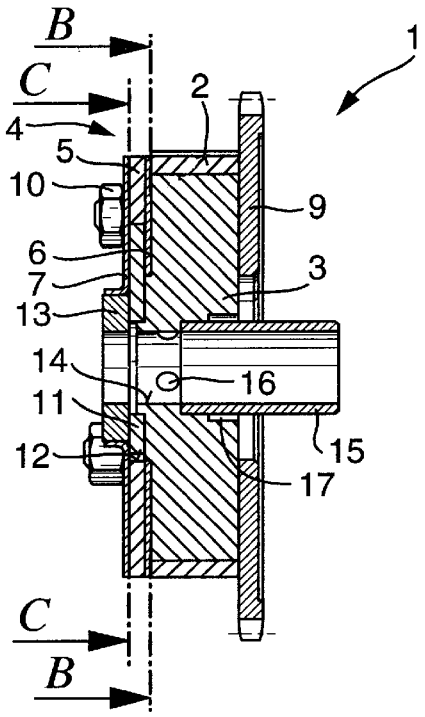
FIG. 1, a section A—A through a vane-type adjuster of FIG. 2 comprising an attachment.
Figure 2:
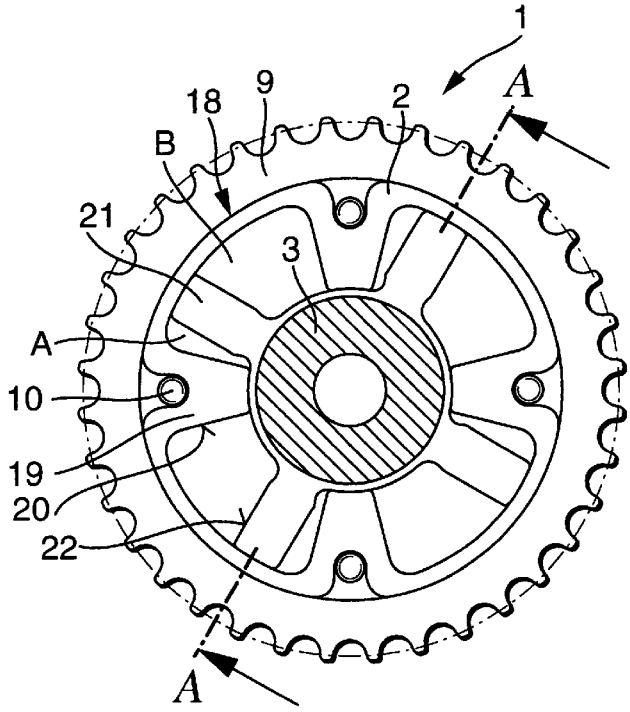
FIG. 2, a section B—B through the vane-type adjuster of FIG. 1.
Figure 4:
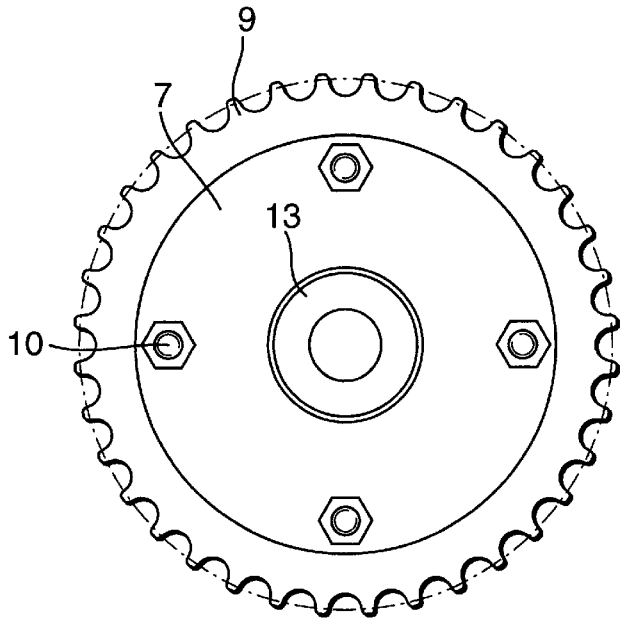
FIG. 4, an outer view of the cover-end of the vane-type adjuster of FIG. 1.

FIG. 1 shows a longitudinal section A—A through a vane-type adjuster 1 of FIG. 2, comprising an outer rotor 2 and an inner rotor 3. On its end directed away from the camshaft, the outer rotor 2 comprises an attachment 4 having an intermediate plate 5 that is connected to a side washer 6 and a cover 7 and that, together with a disc-shaped bushing 11, forms an end closure of the outer rotor 2 on the end directed away from the camshaft. The closure of the outer rotor 2 on the end directed toward the camshaft is formed by a drive pinion 9. The intermediate plate 5, the side washer 6, the cover 7 and the drive pinion 9 are stayed together with the outer rotor 2 by screws 10. The inner rotor 3 is connected to the disc-shaped bushing 11 that is sealingly guided between the side washer 6 and the cover 7 as well as in a coaxial bore 12 (FIG. 3) of the intermediate plate 5. The disc-shaped bushing 11 is screwed to the inner rotor 3 through a sealing ring carrier 13 with a central screw, not shown. The sealing ring carrier 13 seals relative to the cover 7. A sleeve 15 arranged in a stepped central bore 14 of the inner rotor 3 effects a separate supply of pressure oil to working chambers A through first ducts 16, and to working chambers B through second ducts 17.

The cross-section B—B of FIG. 2 through the vane-type adjuster 1 of FIG. 1 shows the outer rotor 2 with hydraulic chambers 18 that are defined by separating walls 19 having radially extending side surfaces 20 and are sealingly divided into working chambers A and B by pivoting vanes 21 that have parallel side surfaces 22. In the stop positions of the pivoting vanes 21, their parallel surfaces 22 lead to the formation of rest volumes in the working chambers A and B in which dirt particles and scuffing chips from the oil circuit can collect. The pivoting vanes 21 are formed integrally on the inner rotor 3.

Figure 3:
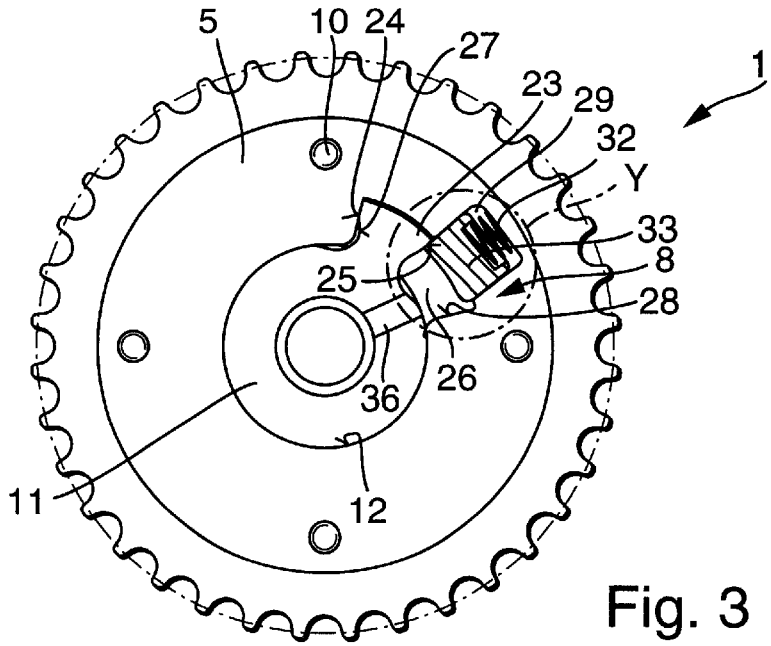
FIG. 3, a section C—C through the attachment of the vane-type adjuster of FIG. 1.
Figure 3A:
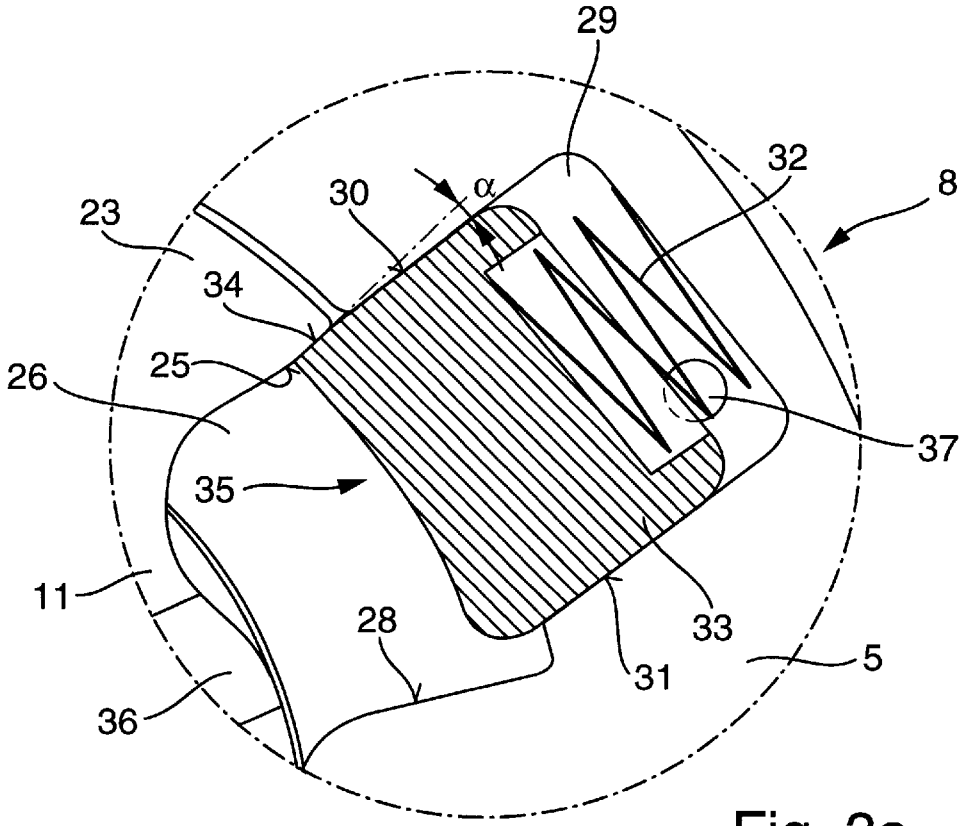
FIG. 3*a*, an enlarged detail Y of the locking device of FIG. 3.

FIG. 3 shows a section C—C through the attachment 4 of the vane-type adjuster 1 of FIG. 1, while FIG. 3*a* is an enlarged representation of the locking device 8. These figures disclose that a peg 23 is arranged on the periphery of the disc-shaped bushing 11 and comprises a first and a second radially extending side surface 24, 25. The peg 23 is arranged in a circular segment-shaped recess 26 of the intermediate plate 5 for pivoting between the radially extending end surfaces of the circular segment-shaped recess 26 that are configured respectively as a retard stop 27 and an advance stop 28.

The intermediate plate 5 comprises a guide groove 29 for parallel first and second guide surfaces 30, 31 of a locking body 33 that is loaded by a locking spring 32. When the peg 23 comes to bear against the retard stop 27, the peg 23 is pushed by the force of the locking spring 32 into the circular segment-shaped recess 26 till a pressure contact is established between a pressure contact surface 34 of the locking body 33 and the second radially extending side surface 25 of the peg 23. The direction of displacement of the locking body 33 forms an acute angle $\alpha$ with the second radially extending side surface 25 of the peg 23. The force acting in peripheral direction on the peg 23 compensates for rotational lash of the camshaft caused by assembly and wear conditions. Because the angle $\alpha$ included between the pressure contact surface 34 and the direction of displacement of the locking body 33 is situated at the borderline of self-locking (quasi self-locking), an unlocking of the locking body 33 under the influence of torque, and a non-releasable clamping are prevented.

The spring-distal end 35 of the locking body 33 is in fluid communication through a radial flow groove 36 with the working chamber A, and the spring-proximate end of the locking body 33 is in fluid communication through a vent bore 37 with the working chamber B. This arrangement is appropriate for achieving a clamp-free unlocking of the locking body 33 of an inlet camshaft adjuster. This is locked on the retard stop in whose direction, upon starting of the engine, the inlet camshaft is loaded by its frictional torque and the locking body 33 is relieved of load. In the case of an outlet camshaft adjuster, the clamp-free unlocking requires a stepped locking body that is loaded by the oil pressure of the working chambers A and B.

Because the radius of the spring-distal end 35 of the locking body 33 is larger than the outer radius of the circular disc-shaped bushing 11, only a line contact that reduces wear is produced between these two surfaces.

Figure 5:
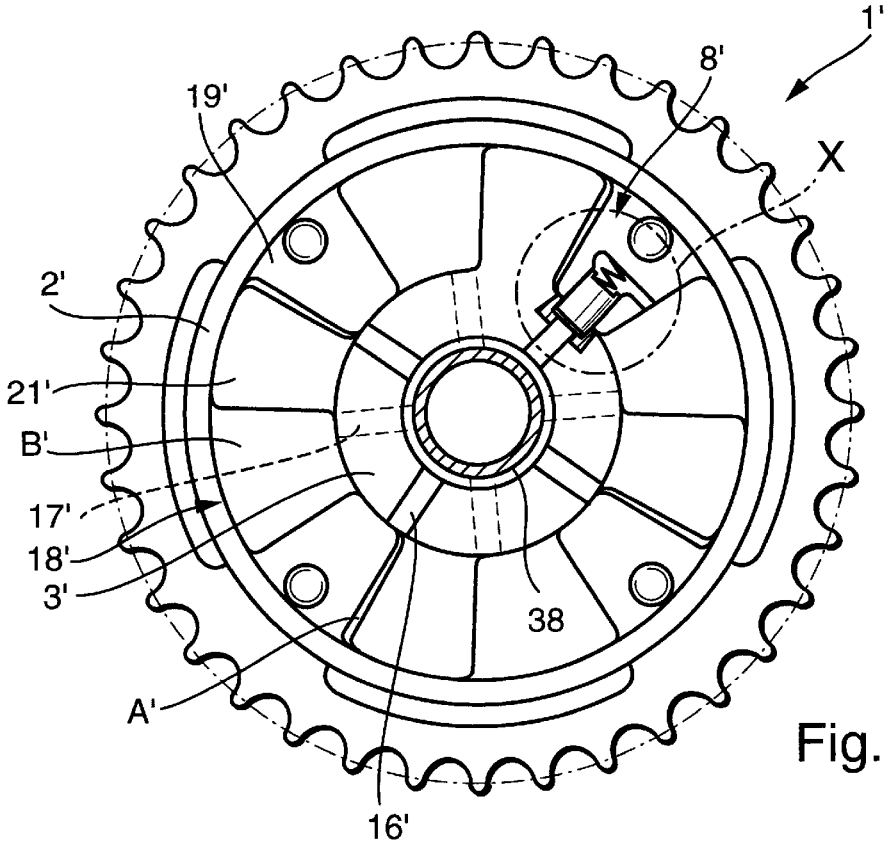
FIG. 5, a vane-type adjuster with an alternative arrangement of the locking device.

An alternative arrangement of the locking device is shown in FIG. 5. The rotary piston adjuster is a vane-type adjuster 1' of a conventional design having an outer rotor 2' and an inner rotor 3' comprising pivoting vanes 21'. The outer rotor 2' is divided by separating walls 19' into hydraulic chambers 18' that, in their turn, are sealingly divided into working chambers A' and B' by the pivoting vanes 21'. The working chambers A' and B' are supplied with pressure oil through a first and a second duct 16' and 17'. The first duct 16' is in fluid communication with an annular space 38.

Figure 5A:
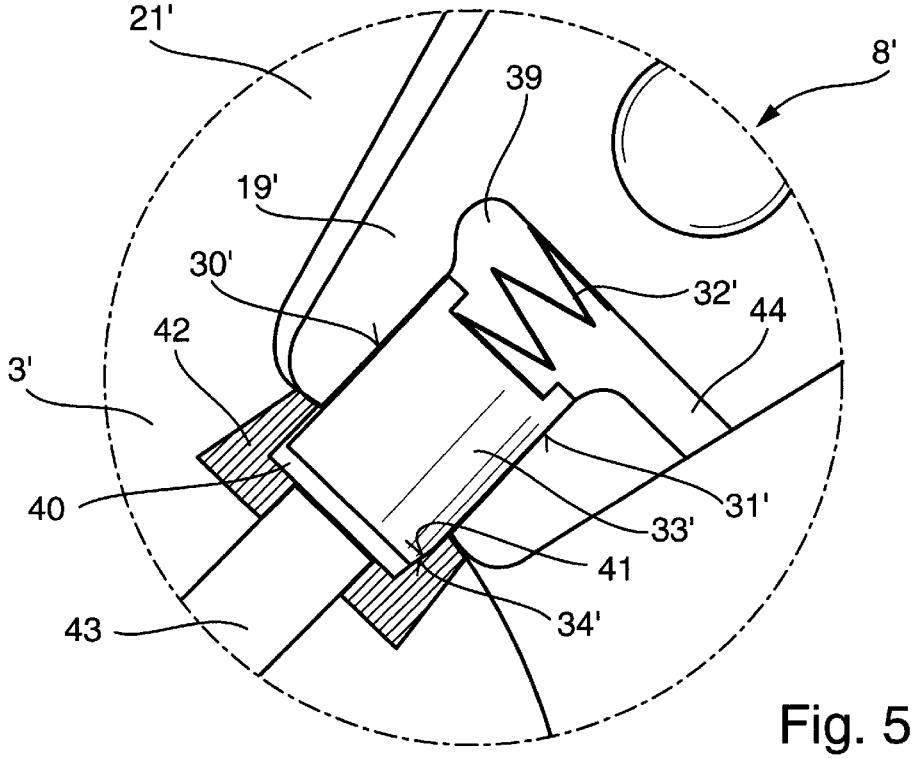
FIG. 5*a*, an enlarged detail X of the locking device of FIG. 5.

FIG. 5*a* is an enlarged representation of the detail X of FIG. 5 showing the locking device 8'. A locking body 33' that is likewise configured as a flat slide comprises parallel guide surfaces 30' 31' that are guided in a radial guide groove 39. This is arranged in the end face of one of the separating walls 19'. In one of the stop positions of the inner rotor 3', the locking body 33' is pushed by a locking spring 32' into a groove 40 that is arranged in the end face and the periphery of the inner rotor 3' to extend parallel to the axis thereof. The groove 40 has a leg comprising an approximately radially extending bevel 41 that can be brought into pressure contact in peripheral direction with a corresponding counter bevel of a pressure contact surface 34' of the locking body 33'. In this way, rotational lash of the camshaft caused by assembly and wear conditions is compensated for in this embodiment as well. The bevel 41 is chosen so that, due to the quasi self-locking, the locking body 33' cannot be unintentionally unlocked. To reduce wear, the groove 40 comprises a lining 42 of wear-resistant material out of which the locking body 33' is also made.

The unlocking of the locking body 33' is effected through a radial groove 43 that is arranged in the end face of the inner rotor 3' and is in fluid communication with the working chamber A' through the annular space 38. The spring-proximate end of the locking body 33' is in fluid communication with the working chamber B' through a vent groove 44. The uncomplicated communication with the working chamber B' also permits a simple realization of a stepped locking body that is required for a clamp-free unlocking through the oil pressures of the working chambers A' and B'.

The arrangement of the locking device shown in FIGS. 5 and 5*a* requires no additional axial design space. But this advantage can only be availed of if the rotary piston adjuster has internal retard and advance stops which likewise require no additional axial design space.

The locking device of the invention in its different embodiments offers a lash- and clamp-free locking and unlocking of the rotary piston adjuster. It requires only a small amount of construction work and offers great durability.

Moreover, the attachment 4 of the invention comprising the locking device 8 and the retard and advance stops 27, 28 is suitable for attaching to any kind of rotary piston adjuster and also on camshaft adjusters based on the principle of orbital low-speed hydraulic motors.

List of Reference Numerals

1 Vane-type adjuster
1' Vane-type adjuster
2 Outer rotor
2' Outer rotor
3 Inner rotor
3' Inner rotor
4 Attachment
5 Intermediate plate
6 Side washer
7 Cover
8 Locking device
8' Locking device
9 Drive pinion
10 Screw
11 Disc-shaped bushing
12 Coaxial bore
13 Sealing ring carrier
14 Central bore
15 Sleeve
16 First duct
16' First duct
17 Second duct
17' Second duct
18 Hydraulic chamber
18' Hydraulic chamber
19 Separating wall
19' Separating wall
20 Radially extending side surface
21 Pivoting vane
21' Pivoting vane
22 Parallel side surface
23 Peg
24 First radially extending side surface
25 Second radially extending side surface
26 Circular segment-shaped recess
27 Retard stop
28 Advance stop
29 Guide groove
30 First guide surface
30' First guide surface
31 Second guide surface
31' Second guide surface
32 Locking spring
32' Locking spring
33 Locking body
33' Locking body
34 Pressure contact surface
34' Pressure contact surface
35 Spring-distal end
36 Radial flow groove
37 Vent bore
38 Annular space
39 Radial guide groove
40 Groove
41 Bevel
42 Lining
43 Radial groove
44 Vent groove

What is claimed is:

1. A rotary piston adjuster for adjusting the angular position of the camshaft of an internal combustion engine, said adjuster comprising an outer rotor connected to a drive pinion and an inner rotor connected to the camshaft, the outer rotor comprising at least one hydraulic chamber having radial separating walls and the inner rotor comprising at least one pivoting vane that sealingly divides the hydraulic chamber into working chambers A and B and can pivot hydraulically between a retard stop position and an advance stop position, said adjuster further comprising a locking device suitable for detachably connecting the outer and the inner rotors, characterized in that the locking device (8) comprises a disc-shaped bushing (11) that is connected to the inner rotor (3) and comprises a peg (23) on an outer periphery, said locking device further comprising a locking body (33) that is configured as a flat slide and is connected to the outer rotor (2), said locking device (8) with all components thereof is arranged in an attachment (4) of the rotary piston adjuster, which attachment comprises an intermediate plate (5) having a side washer (6) and a cover (7) and is configured as an end closure of the outer rotor (2) on an end directed away from the camshaft.

2. A rotary piston adjuster according to claim 1, characterized in that the locking body (33) that is configured as a flat slide is sealingly guided between the side washer (6) and the cover (7) in a guide groove (29) of the intermediate plate (5), and the disc-shaped bushing (11) is sealingly guided between the side washer (6) and the cover (7) in a coaxial bore (12) of the intermediate plate (5).

3. A rotary piston adjuster according to claim 1, characterized in that a circular segment-shaped recess (26) is arranged on the periphery of the coaxial bore (12) in the intermediate plate (5), the guide groove (29) of the locking body (33) opens into said recess, and radially extending end surfaces of said recess are configured as a retard stop and an advance stop (27, 28).

4. A rotary piston according to claim 3, characterized in that the peg (23) comprises first and second radially extending side surfaces (24, 25) that serve as stop surfaces, said peg being arranged on the disc-shaped bushing (11) in the circular segment-shaped recess (26) of the intermediate plate (5) for pivoting between the regard and the advance stops (27, 28) of said recess.

5. A rotary piston adjuster according to claim 4, characterized in that, depending on the position of the guide groove (29) of one of the two stop positions of the peg (23), the locking body (33) can be pushed by a locking spring (32) into the circular segment-shaped recess (26) at an acute angle $\alpha$ to one of the radially extending side surfaces (24, 25) of the peg (23) till a pressure contact acting in peripheral direction is established between a preferably radially extending pressure contact surface (34) of the locking body (33) and one of the radially extending side surfaces (24, 25) of the peg (23).

6. A rotary piston adjuster according to claim 5, characterized in that the locking body (33) encloses between its pressure contact surface (34) and its direction of displacement, an angle $\alpha$ that is quasi self-locking.

7. A rotary piston adjuster according to claim 6, characterized in that the spring-distal end (35) of the locking body (33) is in fluid communication with the working chamber A, and its spring-proximate end is preferably in fluid communication with the working chamber B.

8. A rotary piston adjuster of claim 7, characterized in that the separating walls (19) and the pivoting vanes (21) are spaced from each other in pivoting direction even in the stop positions.

9. A rotary piston adjuster for adjusting the angular position of the camshaft of an internal combustion engine, said adjuster comprising an outer rotor connected to a drive pinion and an inner rotor connected to the camshaft, the outer rotor comprising at least one hydraulic chamber having radial separating walls and the inner rotor comprising at least one pivoting vane that sealingly divides the hydraulic chamber into working chambers A and B and can pivot hydraulically between a retard stop position and an advance stop position, said adjuster further comprising a locking device suitable for detachably connecting the outer and the inner rotors characterized in that the locking device 8' comprises a locking body (33') configured as a flat slide that is guided in a radial guide groove (39) in the end face of one of the separating walls (19') of the outer rotor (2') and can be displaced into an opening of the inner rotor (3') in one of the stop positions of the inner rotor (3'), the opening is configured in the end of the inner rotor (3') as a groove (40) extending parallel to the axis of the inner rotor (3') on the periphery thereof, and one of the legs of the groove (40) comprises a radially extending bevel (41) that can be brought into a pressure contact in peripheral direction with a corresponding counter bevel of a pressure contact surface (34') of the locking body (33') through an inward displacement of the locking body (33') by the spring force of a locking spring (32').

10. A rotary piston adjuster according to claim 9, characterized in that the groove (40) is in fluid communication with the working chamber A' through a radial groove (43) arranged in the end of the inner rotor (3'), and the spring-proximate end of the locking body (33') is in fluid communication preferably with the working chamber B' through a vent groove (44) arranged in the end face of a separating wall (19').

* * * * *